United States Patent [19]

Prusak et al.

[11] 4,341,613

[45] Jul. 27, 1982

[54] APPARATUS FOR ELECTROFORMING

[75] Inventors: John J. Prusak; Marshall L. Whitehurst, both of Indianapolis, Ind.

[73] Assignee: RCA Corporation, New York, N.Y.

[21] Appl. No.: 231,266

[22] Filed: Feb. 3, 1981

[51] Int. Cl.[3] ..... C25D 1/10; C25D 17/06

[52] U.S. Cl. ..... 204/281; 204/5; 204/297 R; 204/DIG. 7

[58] Field of Search ..... 204/224 R, DIG. 7, 5, 204/297 R, 297 W, 279, 281

[56] References Cited

U.S. PATENT DOCUMENTS

| | | | |
|---|---|---|---|
| 2,018,471 | 10/1935 | Russell | 204/5 |
| 2,501,823 | 3/1950 | Leedom | 204/5 |
| 2,675,348 | 4/1954 | Greenspan | 204/DIG. 7 |
| 3,414,502 | 12/1968 | Porrata et al. | 204/281 |
| 4,259,166 | 3/1981 | Whitehurst | 204/279 |

*Primary Examiner*—Delbert E. Gantz
*Assistant Examiner*—Donald R. Valentine
*Attorney, Agent, or Firm*—Birgit E. Morris; Edward J. Sites

[57] ABSTRACT

An apparatus is disclosed for holding a matrix during electroforming. The apparatus is secured to the cathode of an electroforming apparatus and consists of a flat disc member having a diameter at least as large as the diameter of the matrix to be duplicated, and a ring member which is adapted to screw onto the outer diameter of the flat disc member so as to hold the matrix in contact with the surface of the disc. Resilient seals are provided in the ring member and disc member which encase and hold the matrix in a liquid-tight fit between the disc member and the ring member during electroforming of replica parts on the surface of the matrix.

5 Claims, 3 Drawing Figures over the edges of the matrix, and which would result in the formation of duplicated parts which were easily separated from the matrix part.

SUMMARY OF THE INVENTION

An apparatus is provided in accordance with the teachings of this invention for holding a matrix during electroforming. The apparatus of this invention is secured to the cathode of an electroforming apparatus and consists of a flat disc member having a diameter at least as large as the diameter of the matrix to be duplicated, and a ring member which is adapted to screw onto the outer diameter of the flat disc member so as to hold the matrix in contact with the surface of the disc. Resilient seals are provided in the ring member and disc member which encase and hold the matrix in a liquid-tight fit between the disc member and the ring member during electroforming of replica parts on the surface of the matrix.

DETAILED DESCRIPTION

Figure 1:
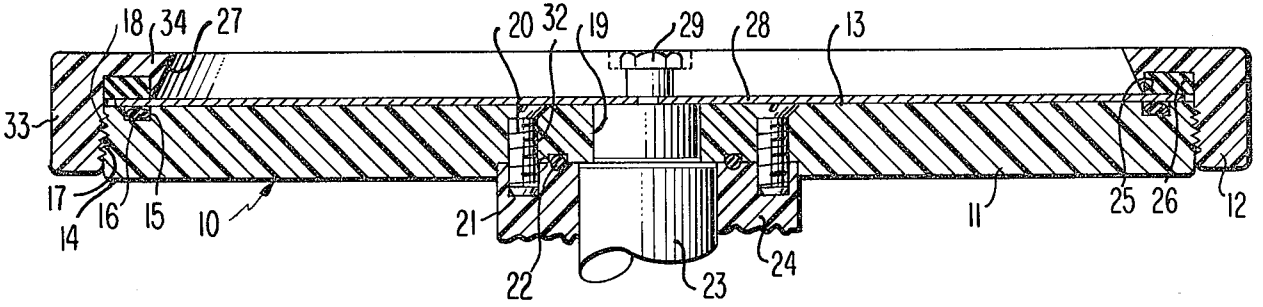
FIG. 1 is a cross-sectional illustration of the apparatus of this invention which is illustrated with a matrix secured to the surface of the apparatus.
Figure 3:
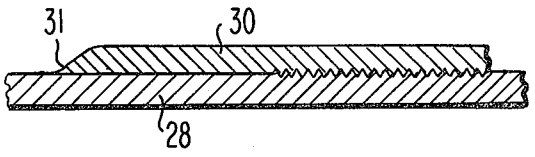
FIG. 3 is a cross-sectional illustration of an edge portion of a matrix and a replicated part formed on the surface of the matrix prior to separation of the parts.
Figure 2:
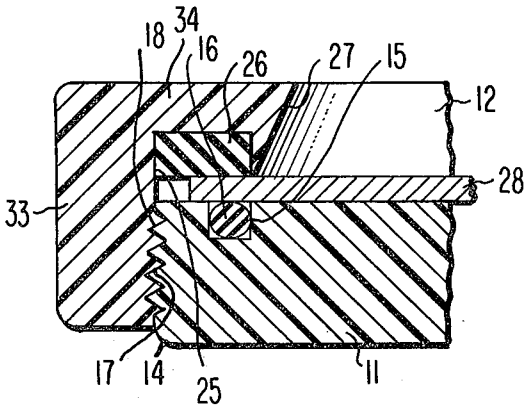
FIG. 2 is an enlarged cross-sectional illustration of an edge portion of the apparatus of FIG. 1.

The apparatus of this invention 10 is comprised of a flat disc member 11 and an outer ring member 12. The disc member 11 and the outer ring member 12 are made of a dielectric material such as a polyester plastic or the like. The ring member 12 and the disc member 11 are preferably made of a relatively rigid material so as to resist deformation in use.

The disc member 11 has a flat face portion 13 and is of a diameter such that a matrix which is to be replicated can be laid flat on the flat face and extend almost to the outer edge 14 of the disc member 11. A concentric circular groove 15 is cut into the surface of the flat face 13. A resilient rubber O-ring seal 16 is positioned in the concentric groove 15. The groove 15 and the resilient rubber O-ring seal 16 have a diameter which is less than the diameter of the matrix which is to be duplicated and is about the same diameter as the replica desired to be formed on the matrix.

The outer edge 14 of the disc member 11 has male threads 17, defined therein, which are cut so as to mate with the female threads 18 on the ring member 12, as will be described below.

The disc member 11 has a center hole 19 which extends through the entire thickness of the disc member 11. The disc member 11, further, has a series of bolt holes 32 about the center hole 19. A groove 21 and an O-ring 22 are positioned around the center hole 19 at the back side of the disc member 11.

The disc member 11 in use is secured to an electrode 23 of a plating apparatus (not shown). The disc member 11 is fastened by means of bolts 20 which are inserted through the bolt holes 32 and into the insulating casing 24 about the cathode 23. The O-ring 22 about the center hole 19 provides a liquid-tight seal of the disc to the end of the cathode 23 which prevents leakage of electrolyte from the plating bath to the cathode 23. The cathode 23 extends through the disc member 11 to the face 13 of the disc where the cathode has an exposed end portion for contacting the matrix to be duplicated.

The ring member 12 has a generally L-shaped cross-sectional configuration with an integral cylindrical portion 33 and a radial portion 34. A female thread 18 is cut on the inner diameter of the cylindrical portion 33 which, as noted above, is adapted to mate with the male thread 17 on the outer edge of the disc member 11. A groove 25 is cut into the under side of the radial portion 34. A rubber seal 26, which, as illustrated, is of a generally square cross-sectional configuration, is positioned within the groove 25. The groove 25 and the seal 26 are located so as to be in an approximate opposing relationship to the groove 15 and the rubber seal 16 in the disc member 11.

The inner edge 27 of the ring member 12 is tapered at a downward extending angle of approximately 30°. Inner edge 27 of the radial portion 34 acts as a plating mask for the outer edge of the matrix 28 and improves the uniformity of the plating of the replica 30 across the surface of the matrix 28. The upper seal 26 limits the diameter of the replica 30 formed on the matrix 28.

When the apparatus 10 is used in plating, this disc member 11 is secured in a fluid-tight fit to the cathode, as illustrated in FIG. 1, with the bolts as described above. The ring member 12 is initially removed from the disc member 11. The matrix 28 which is to be duplicated is placed on the flat face 13 of the disc member 11. The matrix is secured to the exposed end portion of the cathode 23 with a threaded nut 29 which holds the matrix in contact with the cathode 23 and seals the center hole in the matrix to prevent the flow of electrolyte through the hole and under the matrix part 28.

The matrix 28 is placed on the flat face 13 and secured so that the matrix is centered on the disc member 11 with its outer edges approximately equidistant from the outer edge 14 of the disc member 11. The ring member 12 is then screwed onto the disc and is gradually tightened in a downward direction until the seal 26 in the ring member 12 contacts the surface of the matrix 28. The ring then is tightened slightly more so that the seal members are compressed and a liquid-tight seal is made between the seal 26 in the ring member 12 and the exposed upper face surface of the matrix and between the O-ring 16 in the disc and the backside of the matrix.

The matrix 28 is now ready to be replicated in the electroforming apparatus. The assembled apparatus 10 with the matrix secured to the surface is immersed in the electroforming bath in the conventional manner and duplicated.

The plating is conducted in much the same manner as in the prior art. It is preferable to initially start the plating at a relatively low plating rate to insure an initial high quality deposition of metal onto the surface of the matrix. However, once the replating is applied, the plating rate can be continued at a high rate without having to remove the matrix from the electroforming apparatus as in the prior art. An important feature of this invention is that it is not necessary to plate over the outer edges of the matrix prior to commencing the main plating of the matrix part. This is a substantial advantage of the apparatus of this invention 10 in that the replicated part 30 which is formed on the matrix 28 is provided with a feather edge 31 at its outer diameter. The feather edge 31 is a result of the seal mamde by the seal member 26 in the ring member 12 with the surface of the matrix 28 during electroforming. The replicated part 30 can easily be separated from the matrix by sim-

APPARATUS FOR ELECTROFORMING

This invention relates to an improved apparatus for use in the electroforming of record masters, molds, and stampers. More particularly, this invention is concerned with a cathode head assembly for holding matrixes during electroforming of masters, molds, and stampers.

BACKGROUND OF THE INVENTION

In the conventional prior art methods for the manufacture of records, such as audio or the more recently developed high-information density records such as video discs, the information which is desired to be molded into the final record is initially recorded on a magnetic tape. The magnetic tape is then used to control tooling which cuts a surface relief image corresponding to the information recorded on the magnetic tape into a suitable substrate. The recording of the substrates for records which have relatively large patterns of signal elements, such as conventional audio records, are generally cut into relatively soft substrates, such as wax or lacquer substrates. The recordings for the high-information density records such as video discs are cut into relatively hard substrates, such as bright copper substrates, because of the higher accuracy required in cutting the much smaller signal elements employed with this class of records.

After the recordings are cut into the substrates, the substrates are then prepared for electroforming. The surface of the wax or lacquer substrates is activated so as to accept electrodeposited metal. Metal substrates, on the other hand, are passivated to prevent adhesion of the electrodeposited metal to the surface of the substrate.

The recorded surface of the substrate is then electroplated with a metal to provide a master which is a negative reproduction of the recorded substrate. The recorded surface of the metal master is then passivated and in turn is electroplated to form a mold which is a positive reproduction of the recorded substrate. The recorded surface of the mold is in turn passivated and then electroplated to provide a stamper which is again a negative reproduction of the recorded substrate. The stamper is the part which is ultimately mounted on the platen of a record molding machine and is used to mold the records. The above process of making the masters, molds, and stampers is generally referred to in the art as matrixing.

The most common practice heretofore used in the matrixing process for the manufacture of masters, molds, and stampers is to initially apply a preplate over the entire surface of the matrix with care being taken to insure that the plating extends over the outer edge of the matrix. The preplating in the prior art process is deliberately allowed to extend over the outer edges in order to form a grip to physically hold the preplating and the subsequent plating onto the surface of the matrix.

After a substantial thickness of the preplating is applied to the surface of the matrix, it is conventional to apply a rubber ring about the outer edge to form a seal over the edge to prevent further plating of the edge. The application of the rubber ring requires, however, that the plating process be interrupted, the preplated part be removed from the electroplated bath, the ring installed on the preplated part, and then the entire assembly reimmersed into the plating bath for completion of the electrodeposition of the metal on the matrix. The above procedure has not proven to be satisfactory in practice. The discontinuation of the plating process, and the removal of the matrix after application of the preplate, can cause substantial discontinuities and, as a result, a reduction in the quality of the plating on the matrix. Furthermore, if the preplated surface drys in the air after it is removed, there can be a resultant poor adhesion of the plating to the preplated metal. In addition, the requirement of removing the matrix from the electroplating bath after the preplating to install the ring substantially increases the labor cost involved in the plating operation, and also substantially increases the possibility of damage to both the matrix being duplicated and the electroformed part. A still further problem that is encountered is that the plating over the edges of the matrix to form a grip results in considerable difficulty in separating the completed replicated part from the matrix. The plated-over edge has to be mechanically broken by, for example, grinding the edge off and splitting the edge with a knife or the like. The techniques which are used to separate the replicated part from the matrix result in a substantial amount of mechanical damage to both the matrix and the electroformed parts.

It is also suggested in the prior art that resilient rubber edge shields be placed about the outer edge of the matrix before starting plating of the matrix. However, the prior art rubber edge shields are at best only marginally satisfactory when relatively new. When the edge shields are new and are applied correctly by skilled operators, reasonably satisfactory results can be obtained. However, after the edge shields are used a few times, they tend to stretch and allow leakage of electrolyte. Furthermore, if the operators are not careful and do not apply the shield correctly, a substantial amount of leakage of electrolyte occurs about the edges of the shield resulting in an undesirable backplating of the matrixes.

It is also suggested in the prior art to use cathode heads having a rubber back and internal edge shields to hold the matrix to the cathode head during electroforming. Such a combination of cathode head and edge shield is disclosed by L. R. Porrata et al. in U.S. Pat. No. 3,414,502, issued Dec. 3, 1968, entitled ELECTROPLATING APPARATUS FOR USE WITH A PHONOGRAPH RECORD MATRIX. Apparatus, such as that disclosed by L. R. Porrata et al., has disadvantages similar to those described above for the rubber edge shield, in that they tend to allow leakage of electrolyte about the edges of the matrix to the backside of the matrix, which is a highly undesirable condition.

Various other devices have heretofore been suggested in the prior art to improve the quality of plating when making molds, stampers, and the like for the manufacture of records. One such device is disclosed by Whitehurst in U.S. Pat. application Ser. No. 136,032, filed Mar. 31, 1980, now U.S. Pat. No. 4,259,166, entitled SHIELD FOR PLATING SUBSTRATES. Whitehurst provides a masking apparatus which has certain distinct advantages over the prior art apparatus but still has the disadvantages that it is both difficult to assemble and problems are still encountered in separating the electroformed part from the matrix.

It, accordingly, would be highly advantageous if an apparatus could be provided for electroplating of record masters, molds, and stampers, which would prevent leakage of electrolyte between the matrix and the support for the matrix, which would not require plating ply breaking the surface contact of the feather edge to the surface of the matrix. This has proven to be a relatively simple procedure that does not require that the outer edge be ground or that tools and cutters be inserted to break plated-over edges as in the prior art. As a result, there is substantially less chance of damage to the matrix 28 and the replicated part 30 when separating the parts after electroforming.

The apparatus of this invention 10 can be used to replicate the recorded substrates by using the substrate as the matrix 28 and forming the master as the replicated part 30. In turn, the master is then used as the matrix and molds are formed as the replicated part. Then in turn the molds can be used as the matrix to form the stampers. In each of the replicating steps, that is from substrate to master and master to mold and mold to stamper, the replicated part 30 has a slightly smaller diameter than the matrix from which it is replicated because of the placement of the edge seals 16, 27 in the disc member 11 and the ring member 12. Accordingly, some minor compensation should be made for this factor. This, however, has not proven a significant problem in that the feather edge 31 of the replicated part is much more accurate in its diameter than the replicas of the prior art which have plated-over edges. Accordingly, less material has to be allowed for trimming of the replicated parts 30 produced wiht the apparatus of this invention.

The apparatus of this invention has been found to have many additional advantages over the piror art apparatus. The matrix 28 during electroforming is held in a liquid-tight seal so that electrolyte cannot leak behind the matrix and cause the problems which are common in the prior art. The edges of the matrix do not have to be plated over which inherently reduces the cost and improves the quality of the final replicated parts 30. In addition, the parts 30 which are produced using the apparatus of this invention 10 are substantially higher in quality because of the better control of the processing which is available, since it is not required to remove the part 30 during electroforming from the electrolyte as in the prior art. A still further advantage is that the use of the threads to join the ring member 12 and the disc member 11 results in the apparatus 10 being considerably easier to use in practice than the prior art rubber rings, backers, and the like; and the threaded ring and disc are considerably less subject to wear and stretching as compared to the prior art rubber parts.

What is claimed is:

1. An apparatus for holding a flat circular matrix of a first diameter during electroforming of a replica of a second smaller diameter on the surface of the matrix, said apparatus comprising in combination a disc member and a ring member; said ring member having a flat circular configuration with an outer diameter at least as large as said first diameter and having a male thread on the outer edge thereof, said disc member further having a flat face portion for receiving the matrix, said flat face portion including a first concentrically positioned circular seal member of said second diameter located so as to engage a matrix placed on said flat face portion; said ring member having an integral cylindrical portion and a radial portion, said cylindrical portion having an inner diameter with a female thread defined there which is threadably engaged with the male thread on the outer edge of the disc member, said radial portion of the ring member extending radially inward from said first portion for a predetermined distance sufficient to provide a mask over the outer edge of the matrix during electroforming of the replica, said radial portion further including a second concentrically positioned seal member of said second diameter in an opposing relation to said first seal member; whereby when a matrix is placed on said flat face portion of the disc member and the ring member is threaded toward the disc member the first and second seal members engage, hold, and seal the matrix for formation of said replica on the surface of the matrix.

2. The apparatus according to claim 1 which further includes means for securing the disc member to a cathode of an electroforming apparatus.

3. The apparatus according to claim 2 which includes sealing members between the disc and the cathode for preventing leakage of electrolyte to the cathode.

4. The apparatus according to claim 1 wherein the apparatus is made of a dielectric material.

5. The apparatus according to claim 1 wherein the first and second seal members are made of a resilient material and the remainder of the disc members and ring members are made of a rigid dielectric plastic.

* * * * *

UNITED STATES PATENT AND TRADEMARK OFFICE
CERTIFICATE OF CORRECTION

PATENT NO. : 4,341,613

DATED : July 27, 1982

INVENTOR(S) : John J. (NMN) Prusak

It is certified that error appears in the above-identified patent and that said Letters Patent is hereby corrected as shown below:

Col. 2, line 56 "application" should be --Application--.

Col. 4, line 55 "replating" should be --preplating--.

Col. 4, line 65 "mamde" should be --made--.

Col. 5, line 27 "wiht" should be --with-- .

Col. 5, line 30 "piror" should be --prior--.

Signed and Sealed this

*First* Day of *February 1983*

[SEAL]

*Attest:*

GERALD J. MOSSINGHOFF

*Attesting Officer* *Commissioner of Patents and Trademarks*

UNITED STATES PATENT AND TRADEMARK OFFICE
CERTIFICATE OF CORRECTION

PATENT NO. : 4,341,613

DATED : July 27, 1982

INVENTOR(S) : John J. (NMN) Prusak

It is certified that error appears in the above-identified patent and that said Letters Patent is hereby corrected as shown below:

Column 6, line 8 "said ring" should be --said disc--

Signed and Sealed this

*Third* Day of *May 1983*

[SEAL]

*Attest:*

GERALD J. MOSSINGHOFF

*Attesting Officer*

*Commissioner of Patents and Trademarks*